US006127930A

United States Patent [19]

Steffanus

[11] Patent Number: 6,127,930

[45] Date of Patent: Oct. 3, 2000

[54] MOTION RESPONSIVE SWIMMING POOL SAFETY MAT

[76] Inventor: Robert D. Steffanus, 108 Ohio St., McKees Rocks, Pa. 15136

[21] Appl. No.: 09/452,002

[22] Filed: Nov. 30, 1999

Related U.S. Application Data

[60] Provisional application No. 60/110,545, Dec. 2, 1998.

[51] Int. Cl.[7] ..... G08B 23/00

[52] U.S. Cl. ..... 340/573.1; 340/573.6; 340/539; 340/604; 4/495; 4/496; 4/498

[58] Field of Search ..... 340/573.1, 573.6, 340/539, 604; 4/504, 495, 496, 498, 503

[56] References Cited

U.S. PATENT DOCUMENTS

| | | | |
|---|---|---|---|
| 1,091,909 | 3/1914 | Birmingham . | |
| 1,796,762 | 3/1931 | Paston . | |
| 2,812,520 | 11/1957 | Pinckard . | |
| 2,970,320 | 2/1961 | Karp . | |
| 3,000,017 | 8/1961 | Skovira . | |
| 3,413,661 | 12/1968 | Ross . | |
| 3,423,768 | 1/1969 | Glenn . | |
| 3,668,711 | 6/1972 | Liermann et al. . | |
| 3,760,432 | 9/1973 | Glorist . | |
| 3,813,704 | 6/1974 | Troiano | 4/172 |
| 3,889,303 | 6/1975 | Kinzel . | |
| 4,129,905 | 12/1978 | Niemirow . | |
| 4,236,258 | 12/1980 | Ratstone . | |
| 4,747,168 | 5/1988 | Sing . | |
| 5,019,802 | 5/1991 | Brittain et al. | 340/522 |
| 5,091,714 | 2/1992 | De Solminihac | 340/573 |
| 5,267,358 | 12/1993 | Roy et al. | 4/504 |
| 5,832,547 | 11/1998 | Burroughs | 4/504 |

*Primary Examiner*—Jeffrey A. Hofsass
*Assistant Examiner*—Hung Nguyen
*Attorney, Agent, or Firm*—Law Offices of K. Patrick McKay

[57] ABSTRACT

An automatically inflatable mattress adapted to rest on a bottom of a swimming pool in its deflated position and inflates using compressed air pumped through air inflation lines that are coiled around spring loaded hose reels. A microprocessor actuates a compressed air pump as a person interrupts a signal pattern produced by microwave sensors disposed around the perimeter of the swimming pool. The mattress uniformly rises up to the surface of the swimming pool to catch a distressed individual whose motion is detected after falling into the water.

8 Claims, 4 Drawing Sheets

MOTION RESPONSIVE SWIMMING POOL SAFETY MAT

SPECIFIC REFERENCE

This application claims benefit of priority date so established for provisional application Ser. No. 60/110,545, filed Dec. 2, 1998 for Motion Responsive Swimming Pool Safety Mat.

BACKGROUND OF THE INVENTION

1. Field of the Invention

The present invention relates generally to a device that prevents drowning accidents in swimming pools. A mattress is provided which automatically inflates from an air compressor and rises to the surface of the swimming pool upon actuation by the interruption of a microwave sensor detection pattern. This provides a cushioned barrier between the surface of the swimming pool and the underwater region.

2. Description of the Related Art

Safeguarding one's swimming pool has become just as important as having and enjoying such an amenity for the home or business owner. Unfortunately, lifeguards are never the solution for preventing drowning accidents at a private home or small business location, like motels. They cannot protect publicly accessible pools twenty-four hours a day.

Solutions to the problem have been developed as seen in the prior art. The most effective way of preventing accidental drowning has been the implementation of retractable hard covers that can be raised to the surface of the swimming pool. However, such methods using large ropes and nets actuated by pulleys or cranks can require the intervention of a person during the emergency. They detract from the aesthetic benefit of having a swimming pool. Systems which employ underground hydraulics or water jets that raise pool safety platforms can also be extremely expensive.

Signaling alarms can alert others to render assistance, but this requires an individual to wear a device, and, again, requires the help of outsiders in the proximate area. Alarms can only call attention to a potential drowning, not prevent it.

The present invention solves the problem of installation cost, aesthetic preservation, and independence from human intervention by providing an automatically-inflatable mattress, actuated by the interruption of microwave patterns from sensors disposed around the perimeter of a swimming pool. This is an improvement on other automatic sensing devices that have been accredited. The prior art teaches automatic actuation but all suffer from high cost and/or low dependability.

PRIOR ART

U.S. Pat. No. 2,970,320 (Karp) Feb. 7, 1961, shows a combination pool cover and floor that serves to ease the means by which a pool cover is placed by being capable of automatically being lowered to the bottom of the pool by the use of air cylinders. The depth of the pool could also vary, and the necessity for a fence would be eliminated as it relates to trespassers.

U.S. Pat. No. 1,091,909 (Birmingham) Mar. 31, 1914, demonstrates a swimming pool bottom that, by being manually raised by hinged connections, would rise up and save a person who is drowning.

U.S. Pat. No. 4,129,905 (Niemirow) Dec. 19, 1978, teaches a netting that is submerged in a pool and, by means of an inflatable bladder, would rise up to the surface thereby preventing drowning of endangered victims.

U.S. Pat. No. 1,796,762 (Paston) Mar. 17, 1931, shows a life-saving device comprising a large net that can be raised in water to lift a person in distress. A siren is sounded automatically prior to and during the process. The construction also lends itself to serve those in need at the shores of lakes or seacoasts.

U.S. Pat. No. 2,812,520 (Pinckard) Nov. 12, 1957, demonstrates a net pool guard that can be both manually and automatically vertically lifted which would rise to prevent people and animals from drowning or submerging. The means by which the net is raised consists of a multi-path light beam that, when interrupted by passing objects, would actuate the mechanism enabling the lifting process from the bottom of the pool.

U.S. Pat. No. 3,000,017 (Skovira) Sep. 19, 1961, teaches a safety net that can be raised to the surface and be used as a pool cover by means of a frame whereon an inflatable and deflatable pneumatic tube rests. Submerged, the net rests just above the bottom of the pool, and it can be actuated to raise and sound an alarm when an object or persons weight triggers a compressed air valve on the spring loaded net, thereby serving to help drowning victims.

U.S. Pat. No. 3,413,661 (Ross) Dec. 3, 1968, shows a swimming pool cover that is automatically lowered and raised by means of a pair of hydraulic cylinders recessed in the bottom of the pool.

U.S. Pat. No. 3,423,768 (Glenn) Jan. 28, 1969, demonstrates a pool safety platform that rests on the bottom and can be powered to rise using the forcing out of water from ballast tanks wherein compressed air is injected. Discontinuance of the compressed air allows the cover to sink.

U.S. Pat. No. 3,668,711 (Liermann) Jun. 13, 1972, shows a swimming pool cover that can be used as a rescue device as it is capable of rising to the surface using a drum and pulley system. On the surface, flaps that are on edge during raising are in planar form thereby forming a solid surface cover, thus, have the capability to prevent the falling of leaves or debris into the water.

U.S. Pat. No. 3,760,432 (Glorisi) Sep. 25, 1973, teaches a safety platform utilizing the pool water with a ballast system of an inlet and outlet flow path. It is to be a natural pumping and filtering system. Certain valve control specification allows for different platform depths, thereby changing the pool depth to the liking of the user.

U.S. Pat. No. 3,813,704 (Troiano) Jun. 4, 1974, shows a floatable pool safety cover made of a semi-rigid sheet material supported by floatation pillows capable of rising using compressed air from a poolside compressor.

U.S. Pat. No. 4,236,258 (Batstone) Dec. 2, 1980, demonstrates a liner, particularly for pools, consisting of vinyl serving the purpose of extending the life of the pool. The vinyl, in combination with a membrane shape, corresponds to the internal and surface configurations of the particular pool applications.

U.S. Pat. No. 3,889,303 (Kinzel) Jun. 17, 1975, teaches a pool cover comprising a frame upon which an inflatable and airtight cover would rise to the top of the pool and automatically act as an insulator for the heat. Expulsion of the air in the cover would allow the decorative cover to sink to the bottom of the pool.

U.S. Pat. No. 4,747,168 (Sing) May 31, 1988, shows a pool recovery apparatus that would normally rest on the bottom of the pool in the form of a net and could automatically draw a swimmer in distress out of the water. This is accomplished by having the swimmer wear a signal-sending device that would be actuated to produce an electrical signal received by the remotely controlled apparatus.

U.S Pat. No. 5,091,714 Feb. 25, 1992 (de Solminihac), teaches a device for the prevention of drowning using the principle of underwater acoustic transmission. It involves communication with a hydrophone.

SUMMARY OF THE INVENTION

The objective of the present invention is to prevent drowning accidents by providing an automatically inflatable mattress that is actuated by a dependable microwave pattern which is disrupted when a person falls into the pool. A person in distress is lifted to the surface as the accompanying mattress is filled with compressed air.

A secondary objective is to provide an inconspicuous assemblage to preserve the aesthetic benefit of the swimming pool.

A third objective is to provide an assembly that is economically installed and maintained.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated device, and such further applications of the principles of the invention illustrated herein, as would normally occur to persons skilled in the art to which the invention relates.

Figure 1:
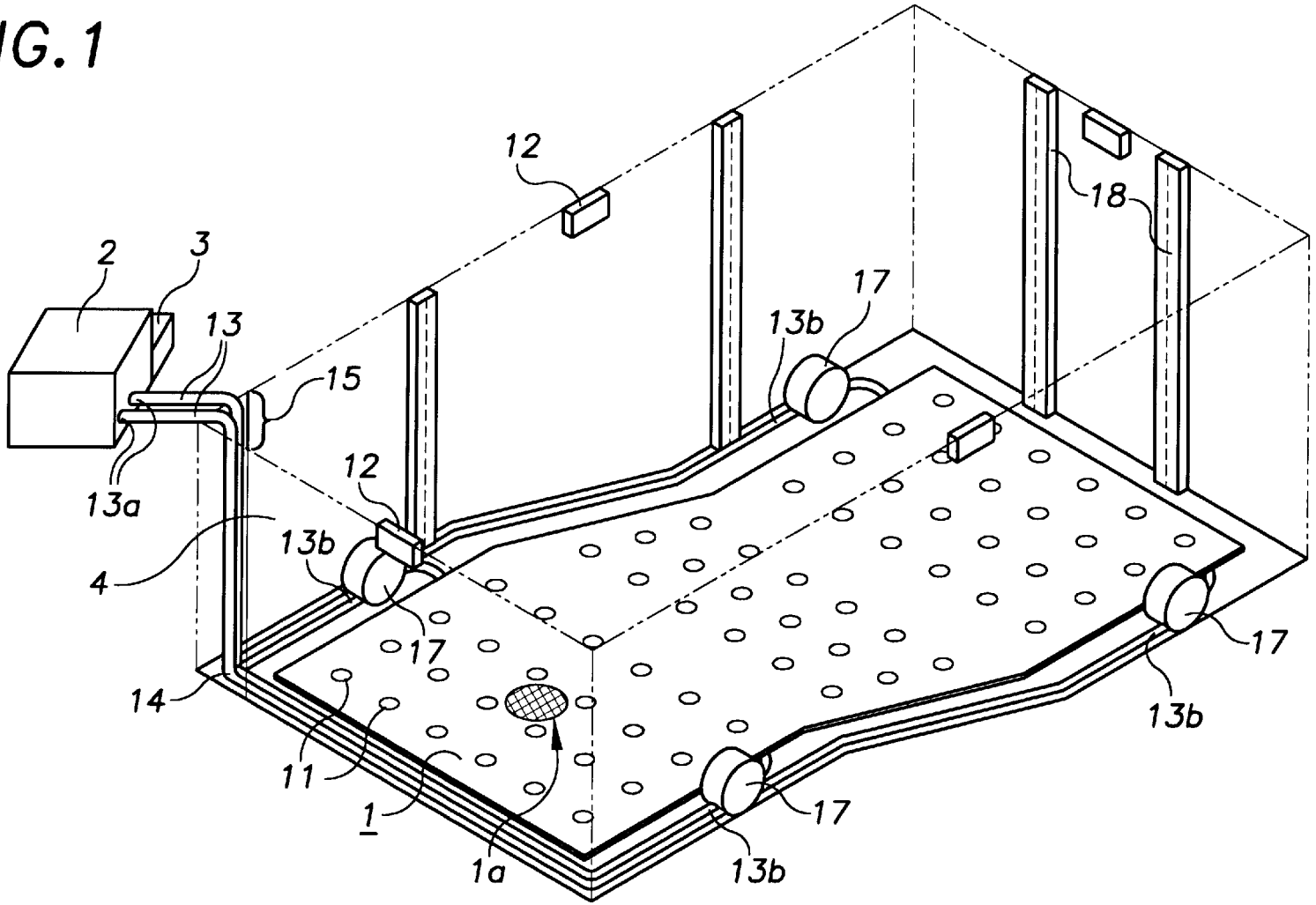
FIG. 1 is a perspective view of the pool safety mat shown in a deflated position resting on the floor of the swimming pool and the pertinent parts of the assembly.

FIG. 1 shows the mattress 1 deflated and positioned at the floor of a swimming pool 4. The mattress 1 can be made of any chlorine-resistant, air-impervious material. The mattress has evenly spaced openings 11, which ensures that inflation does not significantly decrease the overall dimensions of the mattress 1. The mattress 1 may also include a water recirculation screen 1*a*.

The mattress 1 is inflated by an air compressor 2 controlled by a microprocessor 3. The microprocessor 3 triggers the air compressor 2 by reading an interruption in a microwave pattern produced by microwave sensors 12, which are disposed around the perimeter of the swimming pool 4. The air compressor 2 pumps air through the inflation lines 13 which are disposed downward through a protective triangular fairing 15 and run along the floor of the swimming pool 4 to attach to an underside 1*b* (FIG. 2) of the mattress 1. The inflation lines 13, having a distal end 13*b* and a proximal end 13*a* relative to the air compressor 2, are connected through a manifold 14 to diverge and wind around spring loaded hose reels 17 in both the shallow and deep ends of the swimming pool 4. The hose reels 17 give up slack when the mattress inflates and also assist in retracting the mattress upon deflation to lie flat on the floor of the swimming pool 4. Guide rails 18 are disposed around the perimeter of the swimming pool 4 which provide a means for keeping the mattress 1 properly aligned and contained within the area of the swimming pool 4 during the resulting rise and fall from inflation and deflation.

Figure 2:
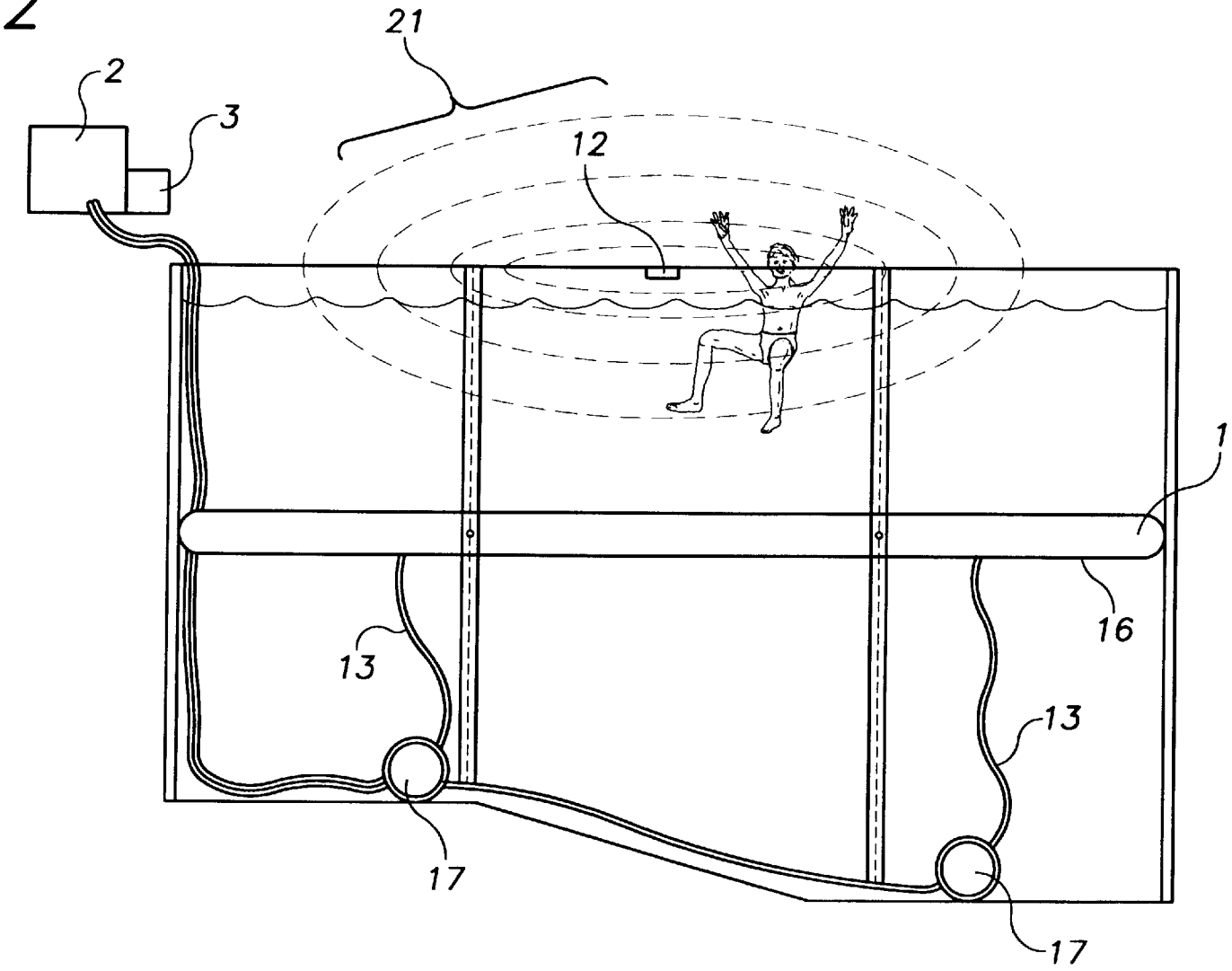
FIG. 2 is a side view of the pool safety mat having been actuated by the presence of an individual.

FIG. 2 shows the mattress 1 rising up to catch a person 20 who has disrupted a signal 21 provided by the microwave sensor 12. The microprocessor 3 triggers the air compressor 2 after reading a disruption in the signal 21 provided by the microwave sensor 12. The air compressor 2 inflates the mattress 1 by pumping air through the inflation lines 13. The mattress 1 inflates to become more buoyant and takes up excess slack from each inflation line 13 at each hose reel 17 while floating to the surface to catch the person 20. The air compressor 2 can be actuated manually for inflation and deflation and the microwave sensors can be disabled to allow normal use of the swimming pool 4 using any variety of switches and indicator lights.

Figure 3:
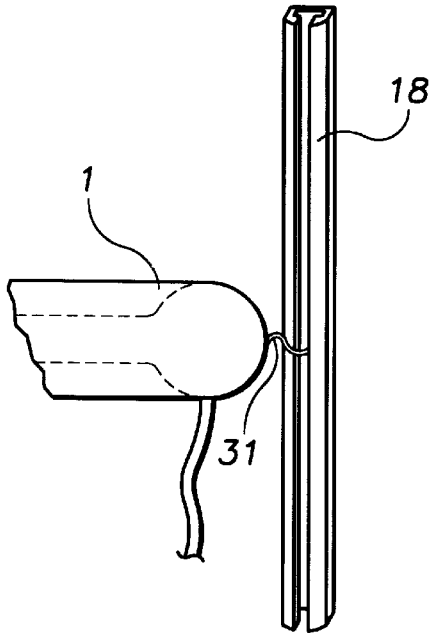
FIG. 3 is a side view close-up of the pool safety mat moveably connected to the guide rail.

FIG. 3 shows the mattress 1 engaged to the guide rail 18. A t-shaped guide 31 moveably fits and slides vertically within each guide rail 18, maintaining the shape of the mattress 1 during the inflation and deflation processes.

Figure 4:
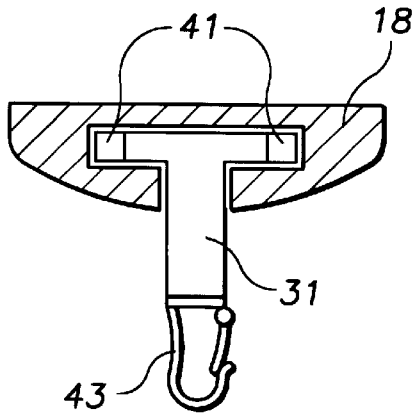
FIG. 4 is a cross-sectional top view of the guide rail showing the connecting means to the pool safety mat within.

FIG. 4 shows a cross-sectional top view of the t-shaped guide 31 disposed within the guide rail 18. The t-shaped guide 31 can employ the use of rollers 41 to assist in vertical movement within the guide rail 18 and also has a mattress-latching hook 43.

Figure 5:
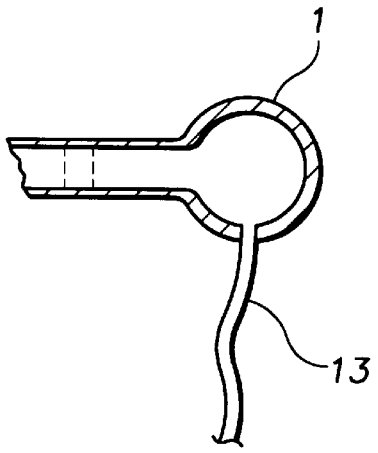
FIG. 5 is cross-sectional side view portion of an end of the pool safety mat.

FIG. 5 is a cross-sectional side view of an end of the mattress 1. The mattress 1 is shaped to have ends deeper in cross-section to urge individuals completely onto the mattress 1 when inflated by way of each inflation line 13.

Figure 6:
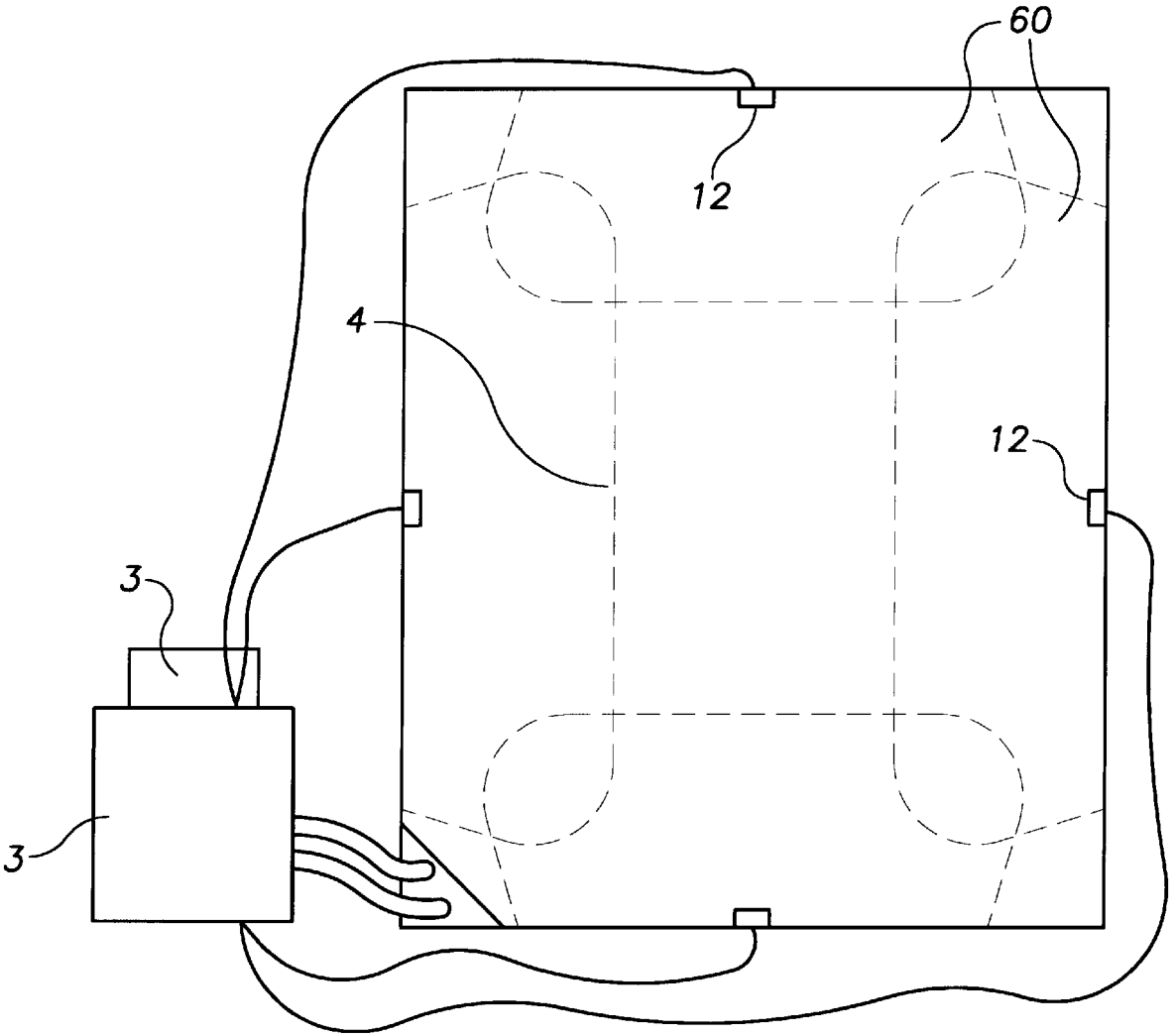
FIG. 6 is a top view of the swimming pool showing an approximate range of the microwave field produced that would sense the motion necessary for operation.

FIG. 6 is a top view of the swimming pool 4 demonstrating the signal patterns 60 produced by microwave sensors 12 disposed around the perimeter of the swimming pool 4. The required perimeter covered by each microwave sensor is adjustable to properly detect motion in an optimum area. The microwave sensors 12 respond to motion using a low power broad microwave beam that can operate on 12 or 24 volts AC or DC.

I claim:

1. An automatically inflatable, swimming pool safety device, comprising:

a mattress having sides and an underside and adapted to be inflated and deflated and initially positioned at a floor of a swimming pool to cover an area of said swimming pool when deflated, said swimming pool having a perimeter and two ends;

a manifold located proximate to each of said ends;

at least two inflation lines having a distal end and proximal end, said distal end connected through said manifold to diverge and run along said floor of said swimming pool and attach to said underside;

an air compressor attached to said proximal end and adapted to pump air to actuate an inflation and deflation of said mattress;

at least two spring loaded hose reels disposed at each of said ends configured to allow said inflation lines to be wound around thereon;

a means for maintaining a shape of said mattress within said area of said swimming pool upon said inflation and said deflation;

a plurality of microwave sensors disposed around said perimeter of said swimming pool, said microwave sensors provide a signal pattern to detect motion in response to a disruption in said signal pattern; and, a microprocessor controlling said air compressor configured to receive said signal pattern permitting said microprocessor to trigger said air compressor to pump said air and inflate and deflate said mattress upon reading said disruption, such that said air compressor inflates said mattress through said inflation lines, whereby said mattress becomes more bouyant and takes up excess slack from each of said inflation lines at each of said hose reels, thereby said mattress floats upward from said floor to catch a person in distress.

2. The swimming pool safety device of claim 1, wherein said signal pattern is a low power, broad microwave beam.

3. The swimming pool safety device of claim 1, wherein said mattress includes evenly spaced openings and a water recirculation screen disposed therein.

4. The swimming pool safety device of claim 1, wherein said mattress has ends deeper in cross-section.

5. The swimming pool safety device of claim 1, wherein said mattress is made of an air-impervious, chlorine-resistant material.

6. The swimming pool safety device of claim 1, wherein said signal pattern is adjustable.

7. The swimming pool safety device of claim 1, wherein said means for maintaining a shape of said mattress, further comprises:

a plurality of mattress latching hooks attached to said sides;

a plurality of t-shaped guides attached to each of said mattress latching hooks; and, a plurality of guide rails having a semicircular cross-section defining a t-shaped cavity, each of said guide rails disposed around said perimeter such that each of said t-shaped guides moveably fits and slides vertically within each of said guide rails.

8. The swimming pool safety device of claim 7, wherein each of said t-shaped guides employs the use of rollers within said t-shaped cavity.

* * * * *